US010025215B1

(12) United States Patent
Morishige

(10) Patent No.: US 10,025,215 B1
(45) Date of Patent: Jul. 17, 2018

(54) CHARGING MEMBER, PROCESS CARTRIDGE, AND IMAGE FORMING APPARATUS

(71) Applicant: FUJI XEROX CO., LTD., Tokyo (JP)

(72) Inventor: Takuya Morishige, Kangawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/586,654

(22) Filed: May 4, 2017

(30) Foreign Application Priority Data

Dec. 27, 2016 (JP) ..... 2016-253468

(51) Int. Cl.
*G03G 15/02* (2006.01)

(52) U.S. Cl.
CPC ..... *G03G 15/0216* (2013.01); *G03G 15/0233* (2013.01)

(58) Field of Classification Search
CPC ..... G03G 15/0216; G03G 15/0233
See application file for complete search history.

(56) References Cited

U.S. PATENT DOCUMENTS

2014/0270853 A1* 9/2014 Uematsu ..... G03G 15/0233 399/176
2014/0295336 A1* 10/2014 Miyagawa ..... G03G 21/18 430/56

FOREIGN PATENT DOCUMENTS

JP 2009-175427 A 8/2009
JP 2010-197936 A 9/2010

* cited by examiner

*Primary Examiner* — Rodney Bonnette
(74) *Attorney, Agent, or Firm* — Sughrue Mion, PLLC

(57) ABSTRACT

A charging member includes a support member, and a surface layer which is provided on the support member and contains a non-conductive porous filler particle and a conductive material present in pores of the non-conductive porous filler particle. The charging member may be included in a process cartridge that is detachable from an image forming apparatus.

12 Claims, 5 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-253468 filed Dec. 27, 2016.

BACKGROUND

1. Technical Field

The present invention relates to a charging member, a process cartridge, and an image forming apparatus.

2. Related Art

For example, the followings are known as a charging member included in an electrophotographic image forming apparatus.

SUMMARY

According to an aspect of the invention, there is provided a charging member including:

a support member; and a surface layer which is provided on the support member and contains a non-conductive porous filler particle and a conductive material present in pores of the non-conductive porous filler particle.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described. Descriptions and examples are used for exemplifying an exemplary embodiment, and are not limited to the scope of the exemplary embodiment of the invention.

In a case where an amount of each component in a composition refers in the specification, in a case where plural types of substances corresponding to each component in the composition are provided, the amount of each component means the total amount of the plural types of substances provided in the composition as long as particular statement is not made.

In the specification, "an electrophotographic photoreceptor" is also simply referred to as "a photoreceptor". In the specification, "a shaft direction" of a charging member is also simply referred to as a direction of a rotation shaft of the charging member.

Charging Member

A charging member according to the exemplary embodiment includes a support member and a surface layer provided on the support member. The surface layer contains a non-conductive porous filler particle and a conductive material present in pores of the non-conductive porous filler particle.

The shape of the charging member according to the exemplary embodiment is not particularly limited. Examples of the shape of the charging member according to the exemplary embodiment include a roll shape illustrated in FIG. 1 and a belt shape.

Figure 1:
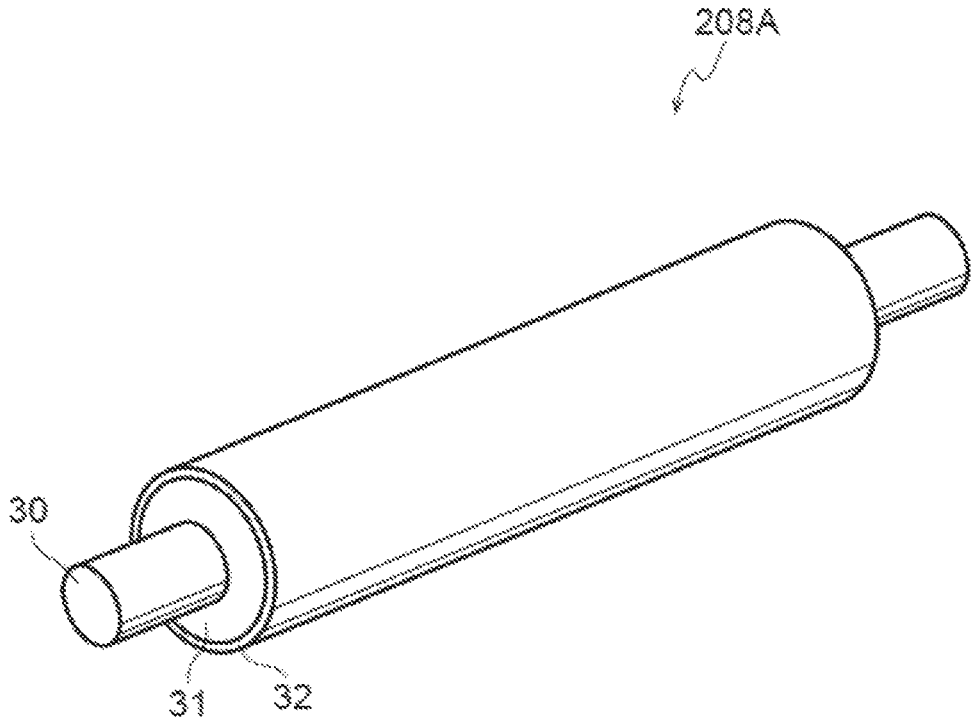
FIG. 1 is a perspective view schematically illustrating an example of a charging member according to an exemplary embodiment.

FIG. 1 is a perspective view schematically illustrating an example of the charging member according to the exemplary embodiment. A charging member 208A illustrated in FIG. 1 includes a support member 30, a conductive elastic layer 31, and a surface layer 32. The support member 30 is a hollow or non-hollow cylindrical member. The conductive elastic layer 31 is provided on an outer circumferential surface of the support member 30. The surface layer 32 is provided on an outer circumferential surface of the conductive elastic layer 31. The configuration of the charging member according to the exemplary embodiment is not limited thereto. The charging member may have another configuration if the charging member includes the support member and the surface layer. For example, the charging member may not include the conductive elastic layer 31 illustrated in FIG. 1, and may include another layer which is not illustrated in FIG. 1, between the support member and the surface layer. The charging member according to the exemplary embodiment may have a configuration in which a belt-shaped support member and a surface layer provided on the support member are provided.

The charging member according to the exemplary embodiment is suitably used as a charging member which is mounted in an electrophotographic image forming apparatus, and is provided to contact a surface of a photoreceptor.

The charging member according to the exemplary embodiment is mounted in an image forming apparatus, as a charging member provided to contact a surface of a photoreceptor, and thus continuously prevents an occurrence of a streaky image defect. That is, the charging member according to the exemplary embodiment prevents the occurrence of a streaky image defect from an initial time of using, and also prevents the occurrence of a streaky image defect when the using continues. The followings are considered as a mechanism thereof.

In the related art, a streaky image defect (minute line in a direction perpendicular to a transport direction and in a direction close to this direction) may occur in an image. It is predicted that the image defect occurs by discharging unevenness of a charging member, and it is known that non-conductive filler particles are caused to be contained in a surface layer of the charging member, so as to form a fine unevenness (unevenness having a height of from about several μm to tens of μm), and thus the occurrence of such an image defect may be prevented.

However, regarding a charging member in which a fine unevenness formed by non-conductive filler particles is provided in the surface layer, the occurrence of a streaky image defect is prevented for an initial time of using, but, if the using continues (for example, after an image is formed on 20,000 sheets of A4 paper), a streaky image defect may occur. The cause is predicted as follows. Contact between the charging member and a photoreceptor repeats, and thus the surface layer of the charging member, particularly, protrusions of the surface layer, which are formed by filler particles are slowly worn. Thus, a conductive material is fallen from the surface layer and accordingly charging capability of the charging member is degraded.

Contrary to the above situation, the charging member according to the exemplary embodiment causes at least a portion of a conductive material contained in the surface layer to be present in pores of a non-conductive porous filler particle. Thus, it is predicted as follows. That is, even though the surface layer is slowly worn, the amount of the conductive material fallen from the surface layer, particularly, the protrusions of the surface layer, which are formed by filler particles is reduced to be small. Thus, even when the using continues, the occurrence of a streaky image defect is prevented.

A situation in which at least a portion of the conductive material contained in the surface layer of the charging member is present in pores of the non-conductive porous filler particle is confirmed by the following method.

A section sample obtained in a manner that the surface layer of the charging member is cut off in a direction which is parallel to a shaft direction of the charging member and is a thickness direction of the surface layer is prepared by a cryo-microtome method. Then, the obtained section sample is observed by a scanning electron microscope. 100 porous filler particles are observed in the section sample. In a case where 30% by number or more of the porous filler particles in which the conductive material is provided on an inner side of a border which is set to be an inner side of 0.5 μm from the contour of a cross section of the porous filler particle are provided among the observed particles, it is determined that the conductive material is present in pores of the porous filler particle.

Each component of the charging member according to the exemplary embodiment will be more specifically described below.

Support Member

The support member is a conductive member functioning as an electrode and a support of the charging member. The support member may be a hollow member or be non-hollow member.

Examples of the support member include a member of metal such as iron (free cutting steel and the like), copper, brass, stainless steel, aluminum, and nickel; an iron member subjected to plating treatment with chrome, nickel, and the like; a member obtained by performing plating treatment on an outer circumferential surface of a resin member or a ceramic member; and a resin or ceramic member which contains a conductive material.

Surface Layer

The charging member according to the exemplary embodiment contains a non-conductive porous filler particle and a conductive material present in pores of the non-conductive porous filler particle.

In the exemplary embodiment, at least a portion of a conductive material contained in the surface layer may be contained in a state of being present in pores of a non-conductive porous filler particle. A portion of the conductive material contained in the surface layer may be contained in a state of being dispersed in a binder resin of the surface layer.

In the exemplary embodiment, at least some of non-conductive porous filler particles contained in the surface layer may contain the conductive material in pores. At least some of the non-conductive porous filler particles contained in the surface layer may not contain the conductive material in pores.

Examples of the non-conductive porous filler particle include a resin particle such as a polyamide resin particle, a polyimide resin particle, an acrylic resin particle, a polystyrene resin particle, a fluorine resin particle, and a silicone resin particle; and an inorganic particle such as a clay particle, a kaolin particle, a talc particle, a silica particle, an alumina particle, and a ceramic particle. The non-conductive porous filler particle may be singly used or may be used in combination of two types or more thereof.

The non-conductive porous filler particle has volume resistivity which is preferably equal to or more than $1\times10^{13}$ Ωcm, as a non-conductive property.

From a viewpoint of controlling surface texture of the charging member, the non-conductive porous filler particles preferably has a number average particle diameter of from 1 μm to 20 μm, more preferably from 2 μm to 10 μm, and further preferably from 3 μm to 8 μm.

An average porosity of non-conductive porous filler particles is preferably from 30% by volume to 70% by volume. If the average porosity is equal to or more than 30% by volume, the amount of the conductive material allowed to be held in pores can become appropriate. If the average porosity is equal to or less than 70% by volume, it is possible to ensure strength as a filler. From the above viewpoints, the average porosity of the non-conductive porous filler particles is more preferably from 40% by volume to 65% by volume, and further preferably from 50% by volume to 60% by volume.

The number average particle diameter and the average porosity of the porous filler particles are measured by the following methods.

A section sample obtained in a manner that the surface layer is cut off in a direction which is parallel to a shaft direction of the charging member and is a thickness direction of the surface layer is prepared by a cryo-microtome method. In an image of the section sample by the scanning electron microscope, sections of 100 porous filler particles are randomly selected. A long diameter (the maximum length of a line linking certain two points on a contour line of each particle section) of the section of each porous filler particle is measured. The number average particle diameter is obtained by using the obtained diameter as a particle diameter of each of the porous filler particles.

A region within the contour of the section of each porous filler particle is converted into a binarized image by using brightness (dark portion in the binarized image is a void.), and a percentage of voids occupying in the area of the region within the contour is calculated. Thus, average porosity of 100 pieces is obtained.

The content of the non-conductive porous filler particle in the surface layer is preferably 3% by volume to 20% by volume, and more preferably from 5% by volume to 15% by volume.

From a viewpoint of preventing the occurrence of a streaky image defect, surface roughness Rz of the surface layer formed by non-conductive porous filler particles is preferably from 2 μm to 15 μm, and more preferably from 3 μm to 10 μm. The surface roughness Rz of the surface layer is ten-point average roughness Rz of JIS B0601: 1994.

As the conductive material, a conductive particle having volume resistivity of $1\times10^{9}$ Ωcm or less is preferable. Examples of the conductive particle include a metal oxide particle of zinc oxide, tin oxide, titanium oxide, and the like;

and carbon black. As the conductive material, the metal oxide particle is preferable from a viewpoint of being easily dispersed in a form of a primary particle, and thus being easily inserted into pores of the porous filler particle by mixing treatment with the porous filler particle. The conductive material may be singly used or may be used in combination of two types or more thereof.

From a viewpoint of being easily inserted into pores of the porous filler particle, the conductive material is preferably a conductive particle having a primary particle diameter of from 5 nm to 100 nm, more preferably a conductive particle having a primary particle diameter of from 10 nm to 80 nm, and further preferably a conductive particle having a primary particle diameter of from 10 nm to 50 nm.

As the conductive material, carbon black, a metal oxide particle, and the like which have a relatively large particle diameter (for example, particle diameter of from several μm to tens of μm) and functions as a filler for forming an unevenness on the surface of the surface layer are also exemplified. In the exemplary embodiment, the conductive material may be dispersed and contained in a binder resin of the surface layer.

The volume resistivity of the surface layer is preferably from $1\times10^5$ Ωcm to $1\times10^2$ Ωcm. The surface layer preferably contains the conductive material of an amount for realizing the volume resistivity in this range (total amount of an amount of being present in pores of non-conductive porous filler particle and an amount of being dispersed and provided in the binder resin).

The content (total amount of the amount of being present in pores of non-conductive porous filler particle and the amount of being dispersed and provided in the binder resin) of the conductive material in the surface layer is preferably from 5 parts by weight to 60 parts by weight, and more preferably from 20 parts by weight to 40 parts by weight, with respect to 100 parts by weight of the binder resin.

In the surface layer, a value of {the amount of the conductive material present in pores of non-conductive porous filler particle/((the amount of the conductive material present in the pores of the non-conductive porous filler particle)+(the amount of the conductive material which is dispersed and provided in the binder resin))} is preferably from 5% by weight to 30% by weight, more preferably from 5% by weight to 25% by weight, and further preferably from 5% by weight to 20% by weight.

Examples of a binder resin in the surface layer include polyamide, polyimide, polyester, polyethylene, polyurethane, phenol resins, silicone resins, acrylic resins, melamine resins, epoxy resins, polyvinylidene fluoride, ethylene tetrafluoride copolymer, polyvinyl butyral, ethylene-tetrafluoroethylene copolymer, fluorine rubber, polycarbonate, polyvinyl alcohol, polyvinylidene chloride, polyvinyl chloride, ethylene vinyl acetate copolymer, and cellulose. The binder resin may be singly used or may be used in combination of two types or more thereof.

An average layer thickness of the surface layer is preferably from 2 μm to 15 μm, and more preferably from 3 μm to 10 μm.

As a forming method of the surface layer, for example, a forming method having the following processes is exemplified: (i) a process in which a non-conductive porous filler particle, a conductive material, a dispersing agent (for example, polymer) of the conductive material, and a solvent are mixed, and stirring is performed by a propeller type stirrer for, for example, 6 hours, and thus a non-conductive porous filler particle containing the conductive material in the pores is prepared; (ii) a process in which the non-conductive porous filler particle containing the conductive material in pores, a binder resin, and a solvent are mixed so as to prepare a composition for forming a surface layer; (iii) a process in which the composition for forming a surface layer is applied onto an outer circumferential surface of a support member (or a support member including a conductive elastic layer); and (iv) a process in which a layer of the composition for forming a surface layer, which is formed on the outer circumferential surface of the support member (or the support member including a conductive elastic layer) is dried. As a method of applying the composition for forming a surface layer onto an outer circumferential surface of a support member (or a support member including a conductive elastic layer), for example, dip-coating, roll coating, blade coating, wire bar coating, spray coating, bead coating, air knife coating, and curtain coating are exemplified.

Conductive Elastic Layer

The charging member according to the exemplary embodiment may include a conductive elastic layer between the support member and the surface layer. The conductive elastic layer may be directly provided on the outer circumferential surface of the support member or may be provided on the outer circumferential surface of the support member with an adhesive layer interposed between the conductive elastic layer and the outer circumferential surface of the support member.

The conductive elastic layer may be a single layer or a multilayer obtained by layering plural layers. The conductive elastic layer may be a conductive foamed elastic layer or a conductive non-foamed elastic layer, or may be obtained by layering a conductive foamed elastic layer and a conductive non-foamed elastic layer.

An exemplary embodiment of the conductive elastic layer contains an elastic material, a conductive material, and other additives.

Examples of the elastic material include polyurethane, nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluorine rubber, natural rubber, and an elastic material obtained by mixing the above substances. Among the above elastic materials, polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, acrylonitrile-butadiene rubber, and an elastic material obtained by mixing the above substances are preferable.

Examples of the conductive material include an electron conductive material and an ion conductive material. As the electron conductive material, powder of the followings is exemplified: carbon black such as furnace black, thermal black, channel black, ketchen black, acetylene black, and color black; pyrolytic carbon; graphite; metal such as aluminum, copper, nickel, stainless steel, and alloys thereof; metal oxide such as tin oxide, indium oxide, titanium oxide, tin oxide-antimony oxide solid solution, and tin oxide-indium oxide solid solution; and a substance obtained by performing conduction treatment on a surface of an insulating substance. Examples of the ion conductive material include perchlorate or chlorate of tetraethyl ammonium, lauryltrimethyl ammonium, benzyltrialkyl ammonium, and the like; and perchlorate or chlorate of alkali metal or alkaline earth metal such as lithium and magnesium. The conductive material may be singly used or may be used in combination of two types or more thereof.

The conductive material preferably has a primary particle diameter of from 1 nm to 200 nm.

The content of the electron conductive material in the conductive elastic layer is preferably from 1 part by weight to 30 parts by weight, and more preferably from 15 parts by weight to 25 parts by weight, with respect to 100 parts by weight of the elastic material. The content of the ion conductive material in the conductive elastic layer is preferably from 0.1 parts by weight to 5 parts by weight, and more preferably from 0.5 parts by weight to 3 parts by weight, with respect to 100 parts by weight of the elastic material.

Examples of other additives to be mixed in the conductive elastic layer include a softening agent, a plasticizer, a curing agent, a vulcanizing agent, a vulcanization accelerator, a vulcanization accelerator aid, an oxidation inhibitor, a surfactant, a coupling agent, and a filler.

Examples of the vulcanization accelerator include thiazole series, thiuram series, sulfenamide series, thiourea series, dithiocarbamate series, guanidine series, and aldehyde-ammonia series. The vulcanization accelerator may be singly used or may be used in combination of two types or more thereof. The content of the vulcanization accelerator in the conductive elastic layer is preferably from 0.01 parts by weight to 10 parts by weight and more preferably from 0.1 parts by weight to 6 parts by weight, with respect to 100 parts by weight of the elastic material.

Examples of the vulcanization accelerator aid include zinc oxide and stearic acid. The vulcanization accelerator aid may be singly used or may be used in combination of two types or more thereof. The content of the vulcanization accelerator aid in the conductive elastic layer is preferably from 0.5 parts by weight to 20 parts by weight and more preferably from 1 part by weight to 15 parts by weight, with respect to 100 parts by weight of the elastic material.

Examples of the filler contained in the conductive elastic layer include calcium carbonate, silica, and clay mineral. The filler may be singly used or may be used in combination of two types or more thereof. The content of the filler in the conductive elastic layer is preferably from 5 parts by weight to 60 parts by weight and more preferably from 10 parts by weight to 60 parts by weight, with respect to 100 parts by weight of the elastic material.

The layer thickness of the conductive elastic layer is preferably from 1 mm to 10 mm, and more preferably from 2 mm to 5 mm. The volume resistivity of the conductive elastic layer is preferably from $1\times10^{3}$ Ωcm to $1\times10^{14}$ Ωcm.

Examples of the adhesive layer interposed between the conductive elastic layer and the support member include a resin layer. Specific examples include resin layers of polyolefin, acrylic resin, epoxy resin, polyurethane, nitrile rubber, chlorine rubber, vinyl chloride resin, vinyl acetate resin, polyester, phenolic resin, silicone resin, and the like. The adhesive layer may contain a conductive material (for example, the electron conductive material or the ion conductive material which are described above).

As a method of forming a conductive elastic layer on a support member, for example, the following methods are exemplified; a method in which a composition for forming a conductive elastic layer in which an elastic material, a conductive material, and other additives are mixed, and a cylindrical support member are extruded together from an extrusion molding machine, a layer of the composition for forming a conductive elastic layer is formed on the outer circumferential surface of the support member, and then the layer of the composition for forming a conductive elastic layer is heated and subjected to a crosslinking reaction, so as to obtain a conductive elastic layer; and a method in which a composition for forming a conductive elastic layer in which an elastic material, a conductive material, and other additives are mixed is extruded from an extrusion molding machine to the outer circumferential surface of a support member having an endless belt shape, a layer of the composition for forming a conductive elastic layer is formed on the outer circumferential surface of the support member, and then the layer of the composition for forming a conductive elastic layer is heated and subjected to a crosslinking reaction, so as to obtain a conductive elastic layer. The support member may include an adhesive layer on the outer circumferential surface thereof.

Image Forming Apparatus, Charging Device, and Process Cartridge

An image forming apparatus according to the exemplary embodiment includes a photoreceptor, a charging device, a latent image forming device, a developing device, and a transferring device. The charging device charges a surface of the photoreceptor and includes the charging member according to the exemplary embodiment. The charging member is provided to contact the surface of the photoreceptor. The latent image forming device forms a latent image on the charged surface of the photoreceptor. The developing device develops the latent image formed on the surface of the photoreceptor by a developer containing a toner, so as to form a toner image. The transferring device transfers the toner image formed on the surface of the photoreceptor to a recording medium.

In the image forming apparatus according to the exemplary embodiment, the charging device may have any of a type of applying only a DC voltage to the charging member and a type of applying a voltage obtained by superimposing an AC voltage on a DC voltage to the charging member.

In the type of applying only a DC voltage to the charging member, a streaky image defect occurs easily more than that in the type of applying a voltage obtained by superimposing an AC voltage on a DC voltage to the charging member. Thus, in the exemplary embodiment, the charging member according to the exemplary embodiment is used as a charging member included in the charging device, and thus the occurrence of a streaky image defect is prevented even in the type of applying only a DC voltage to the charging member.

The image forming apparatus according to the exemplary embodiment may further include at least one selected from devices: a fixing device configured to fix a toner image to a recording medium; a cleaning device configured to perform cleaning of the surface of the photoreceptor after transfer of the toner image and before charging; and an erasing device configured to irradiate the surface of the photoreceptor after transfer of the toner image and before charging, with light so as to perform erasing.

The image forming apparatus according to the exemplary embodiment may be any of apparatuses: a direct transfer type apparatus in which a toner image formed on the surface of the photoreceptor is directly transferred to a recording medium; and an intermediate transfer type apparatus in which a toner image formed on the surface of the photoreceptor is primarily transferred to a surface of an intermediate transfer member and the toner image transferred to the surface of the intermediate transfer member is secondarily transferred to a surface of a recording medium.

A process cartridge according to the exemplary embodiment is a cartridge which is detachable from the image forming apparatus. The process cartridge includes at least a photoreceptor and the charging member according to the exemplary embodiment. The process cartridge according to the exemplary embodiment may further include at least one selected from a developing device, a cleaning device of the photoreceptor, an erasing device of the photoreceptor, a transferring device, and the like.

A configuration of the image forming apparatus, the charging device, and the process cartridge according to the exemplary embodiment will be described below with reference to the drawings.

Figure 2:
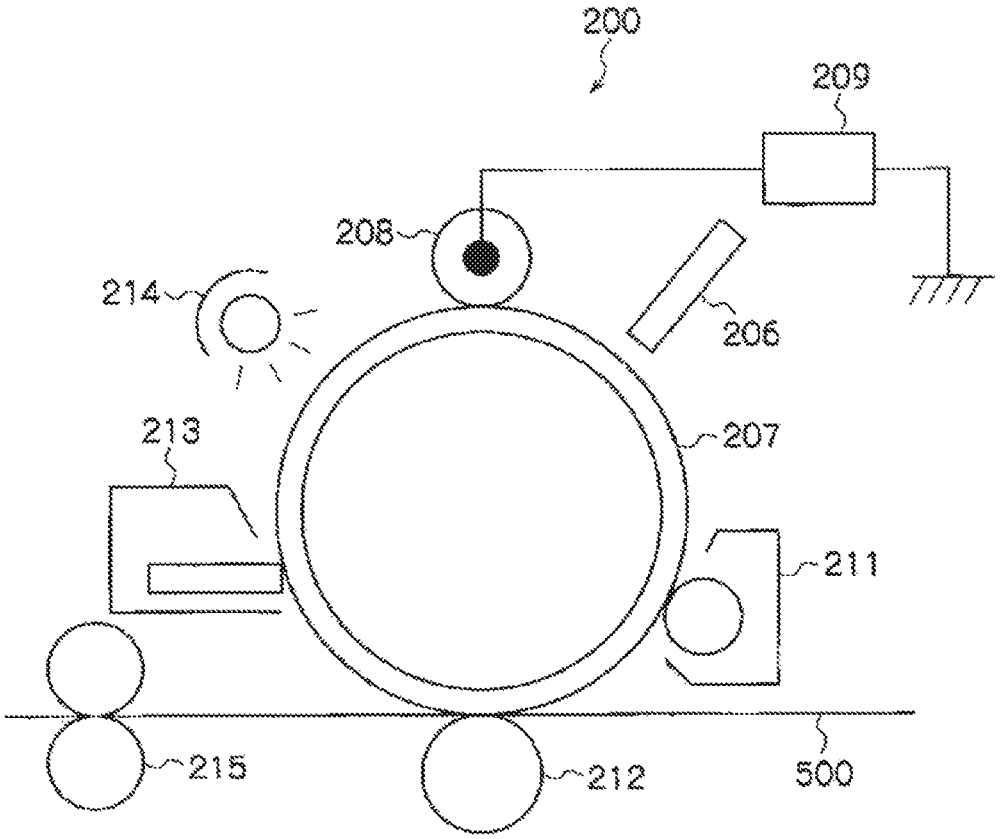
FIG. 2 is a schematic configuration diagram illustrating an example of an image forming apparatus according to the exemplary embodiment.
Figure 3:
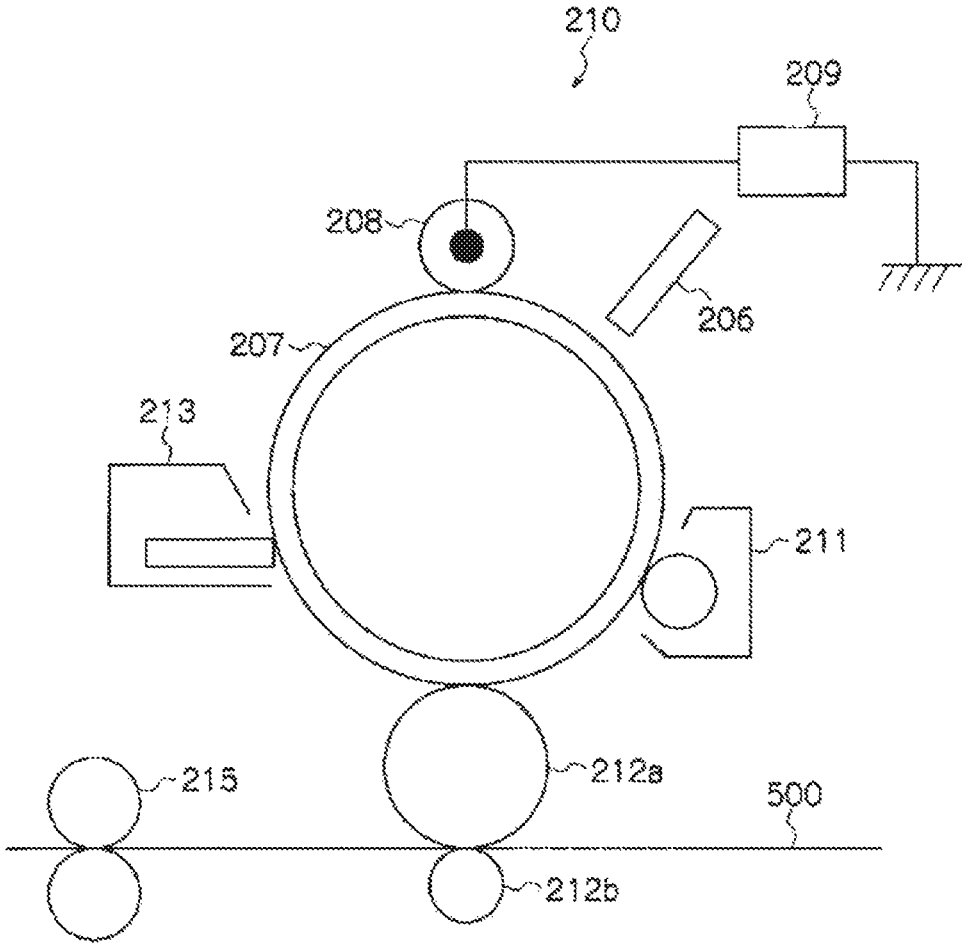
FIG. 3 is a schematic configuration diagram illustrating another example of the image forming apparatus according to the exemplary embodiment.

FIG. 2 is a schematic diagram illustrating a direct transfer type image forming apparatus which is an example of the image forming apparatus according to the exemplary embodiment. FIG. 3 is a schematic diagram illustrating an intermediate transfer type image forming apparatus which is an example of the image forming apparatus according to the exemplary embodiment.

An image forming apparatus 200 illustrated in FIG. 2 includes a photoreceptor 207, a charging device 208, a power source 209, an exposure device 206, a developing device 211, a transferring device 212, a fixing device 215, a cleaning device 213, and an erasing device 214. The charging device 208 charges the surface of the photoreceptor 207. The power source 209 is connected to the charging device 208. The exposure device 206 exposes the surface of the photoreceptor 207 so as to form a latent image. The developing device 211 develops the latent image on the photoreceptor 207 by a developer containing a toner. The transferring device 212 transfers a toner image on the photoreceptor 207 to a recording medium 500. The fixing device 215 fixes the toner image to the recording medium 500. The cleaning device 213 removes the toner remaining on the photoreceptor 207. The erasing device 214 erases the surface of the photoreceptor 207. The erasing device 214 may or may not be included.

An image forming apparatus 210 illustrated in FIG. 3 includes the photoreceptor 207, the charging device 208, the power source 209, the exposure device 206, the developing device 211, a primary transfer member 212*a* and a secondary transfer member 212*b* that transfer a toner image on the photoreceptor 207 to a recording medium 500, the fixing device 215, and the cleaning device 213. The image forming apparatus 210 may or may not include the erasing device, similarly to the image forming apparatus 200.

The charging device 208 is a contact charging type charging device which is configured from a roll-shaped charging member, and is provided to contact the surface of the photoreceptor 207. Only a DC voltage or a voltage obtained by superimposing an AC voltage on a DC voltage is applied to the charging device 208 from the power source 209.

As the exposure device 206, an optical system device which includes a light source such as semiconductor laser and a light emitting diode (LED) is exemplified.

The developing device 211 is a device configured to supply a toner to the photoreceptor 207. The developing device 211 causes a roll-shaped developer holding member to contact the photoreceptor 207 or causes the developer holding member to be close to the photoreceptor 207, for example. The developing device 211 adheres a toner to a latent image on the photoreceptor 207, so as to form a toner image.

As the transferring device 212, for example, a corona discharge generator and a conductive roll configured to be pressed on the photoreceptor 207 through a recording medium 500 are exemplified.

As the primary transfer member 212*a*, for example, a conductive roll configured to contact the photoreceptor 207 and rotate is exemplified. As the secondary transfer member 212*b*, for example, a conductive roll configured to be pressed on the primary transfer member 212*a* through a recording medium 500 is exemplified.

As the fixing device 215, for example, a heating and fixing device which includes a heating roll and a pressure roll pressed on the heating roll is exemplified.

As the cleaning device 213, a device which includes a blade, a brush, a roll, and the like as a cleaning member is exemplified. Examples of a material of a cleaning blade include urethane rubber, neoprene rubber, and silicone rubber.

The erasing device 214 is, for example, a device configured to irradiate the surface of the photoreceptor 207 after transfer, with light, so as to erase the residual potential of the photoreceptor 207. The erasing device 214 may or may not be included.

Figure 4:
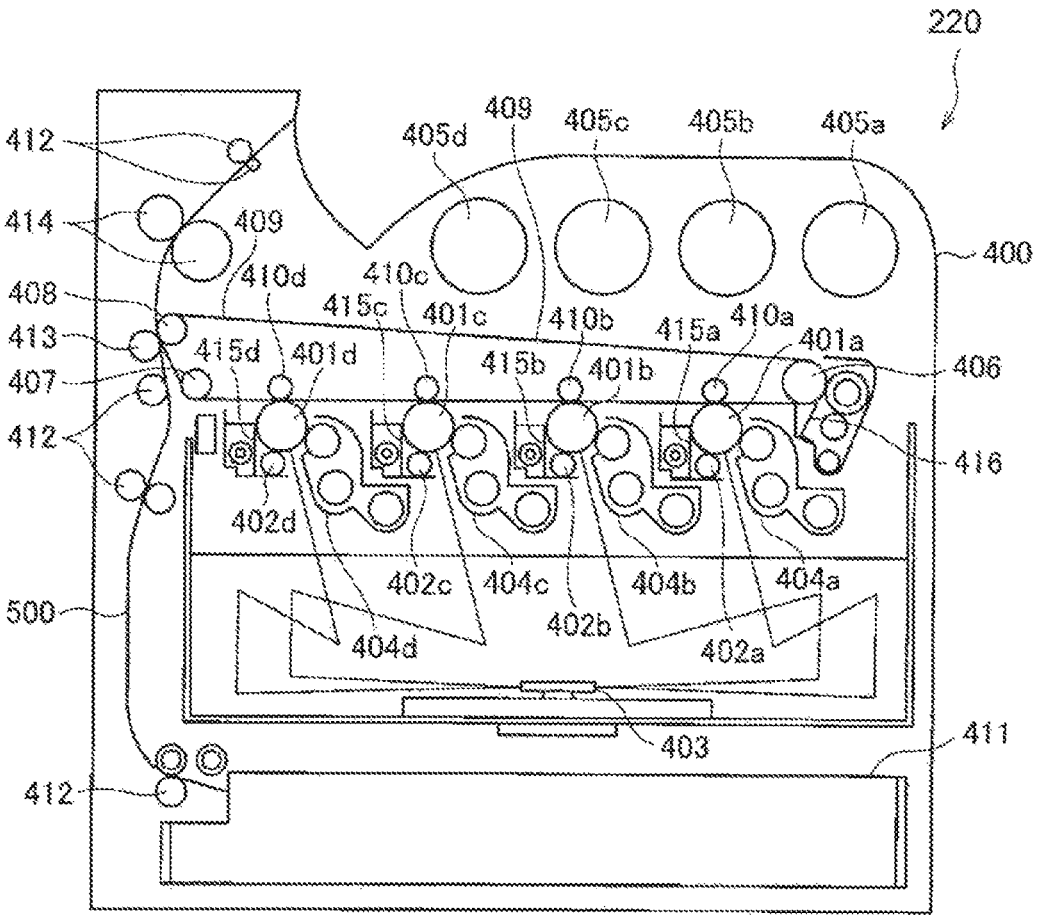
FIG. 4 is a schematic configuration diagram illustrating still another example of the image forming apparatus according to the exemplary embodiment.

FIG. 4 is a schematic diagram illustrating an image forming apparatus of a tandem type and an intermediate transfer type, which is an example of the image forming apparatus according to the exemplary embodiment. The image forming apparatus in FIG. 4 includes four image forming units which are arranged in parallel.

An image forming apparatus 220 includes the four image forming units corresponding to toners of colors, an exposure device 403 including a laser light source, an intermediate transfer belt 409, a secondary transfer roll 413, a fixing device 414, and a cleaning device including a cleaning blade 416, in a housing 400.

The four image forming units included in the image forming apparatus 220 have the same configuration. Thus, a configuration of the image forming unit including a photoreceptor 401*a* as a representative of the units will be described. A charging roll 402*a*, a developing device 404*a*, a primary transfer roll 410*a*, and a cleaning blade 415*a* are provided around the photoreceptor 401*a* in an order of a rotation direction of the photoreceptor 401*a*. The primary transfer roll 410*a* is pressed on the photoreceptor 401*a* through the intermediate transfer belt 409. A toner accommodated in a toner cartridge 405*a* is supplied to the developing device 404*a*.

The charging roll 402*a* is a contact charging type charging device which is provided to contact the surface of the photoreceptor 401*a*. Only a DC voltage or a voltage obtained by superimposing an AC voltage on a DC voltage is applied to the charging roll 402*a* from a power source.

The intermediate transfer belt 409 is stretched by a driving roll 406, a tension roll 407, and a back surface roll 408, and travels by rotation of the rolls.

The secondary transfer roll 413 is provided to be pressed on the back surface roll 408 through the intermediate transfer belt 409.

The fixing device 414 is, for example, a heating and fixing device which includes a heating roll and a pressure roll.

The cleaning blade 416 is a member configured to remove a toner remaining on the intermediate transfer belt 409. The cleaning blade 416 is provided on a downstream of the back surface roll 408, and removes a toner remaining on the intermediate transfer belt 409 after transfer.

A tray 411 configured to accommodate a recording medium 500 is provided in the housing 400. A recording medium 500 in the tray 411 is transported to a contact portion between the intermediate transfer belt 409 and the secondary transfer roll 413, and is transported to the fixing device 414 by a transport roll 412. Thus, an image is formed on the recording medium 500. The recording medium 500 after an image is formed is discharged to the outside of the housing 400.

Figure 5:
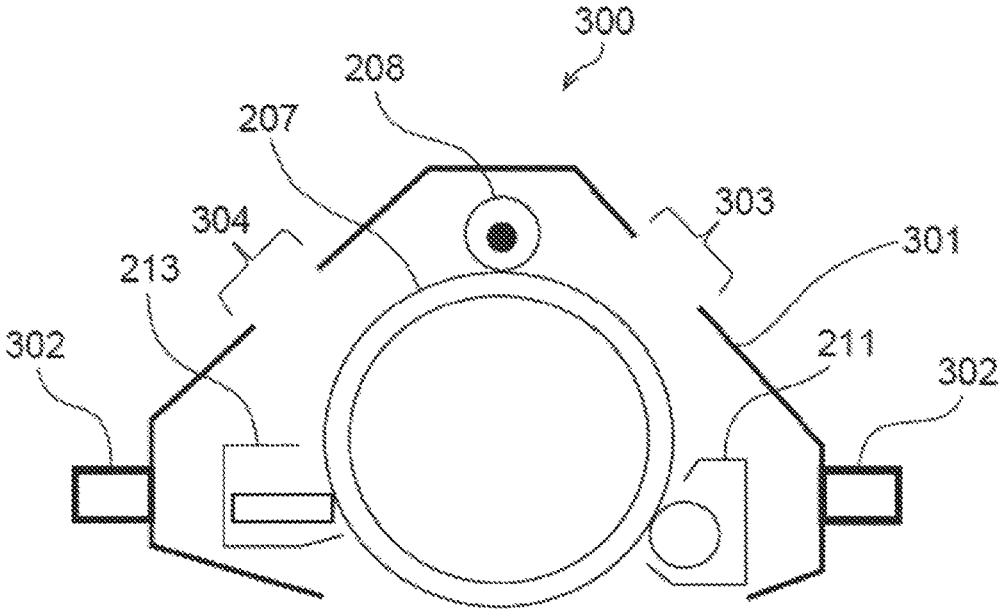
FIG. 5 is a schematic configuration diagram illustrating an example of a process cartridge according to the exemplary embodiment.

FIG. 5 is a schematic diagram illustrating an example of the process cartridge according to the exemplary embodiment. A process cartridge 300 illustrated in FIG. 5 is detachable from an image forming apparatus which includes an exposure device, a transferring device, and a fixing device, for example.

In the process cartridge 300, the photoreceptor 207, the charging device 208, the developing device 211, and the cleaning device 213 are integrated by a housing 301. Amounting rail 302, an opening portion 303 for exposure, and an opening portion 304 for erasing and exposure are provided in the housing 301. The mounting rail 302 is used when the process cartridge is detachable from the image forming apparatus.

The charging device 208 included in the process cartridge 300 is a contact charging type charging device which is configured from a roll-shaped charging member, and comes into contact with the surface of the photoreceptor 207 so as to charge the surface of the photoreceptor 207. When the process cartridge 300 is mounted in the image forming apparatus and image formation is performed, only a DC voltage or a voltage obtained by superimposing an AC voltage on a DC voltage is applied to the charging device 208 from a power source.

Developer and Toner

A developer applied to the image forming apparatus according to the exemplary embodiment is not particularly limited. The developer may be a single-component developer which contains only a toner, or may be a two-component developer which contains a mixture of a toner and a carrier.

A toner contained in the developer is not particularly limited. The toner contains a binder resin, a coloring agent, and a release agent, for example. Examples of the binder resin of a toner include polyester and styrene-acrylic resin.

An external additive may be externally added to the toner. Examples of the external additive of the toner include, for example, an inorganic fine particle of silica, titania, alumina, and the like.

The toner is prepared in a manner that a toner particle is prepared and an external additive is externally added to the prepared toner particle. Examples of a preparing method of a toner particle include a kneading and pulverizing method, an aggregation coalescence method, a suspension polymerization method, and a dissolution suspension method. The toner particle may be a toner particle having a single-layer structure or may be a toner particle having a so-called core and shell structure in which a toner particle is configured by a core (core particle) and a shell layer (shell layer) for coating the core.

A volume average particle diameter (D50v) of toner particles is preferably from 2 μm to 10 μm, and more preferably from 4 μm to 8 μm.

A carrier contained in a two-component developer is not particularly limited. Examples of the carrier include a coated carrier in which a surface of a core formed from magnetic particles is coated with a resin; a magnetic particle dispersion type carrier in which magnetic particles are dispersed and mixed in a matrix resin; and a resin-impregnated type carrier in which a resin is impregnated in a porous particle.

A mixing ratio (weight ratio) of a toner and a carrier in a two-component developer is preferably toner:carrier=1:100 to 30:100, and more preferably 3:100 to 20:100.

EXAMPLES

The exemplary embodiment of the invention will be described below in detail by using examples. However, the exemplary embodiment of the invention is not limited to the examples. In the following descriptions, "a part" is on the basis of weight.

Preparation of Charging Roll

Example 1

Formation of Conductive Elastic Layer

A mixture having the following composition is kneaded by a kneader, and thus a rubber composition (1) is obtained.

- Rubber material (epichlorohydrin-ethylene oxide-allyl glycidyl ether copolymerized rubber, HYDRINT3106 manufactured by Japan Zeon Corporation): 100 parts by weight
- Conductive material (carbon black, #3030B manufactured by Mitsubishi Chemical Corporation): 5 parts by weight
- Ion conductive material (benzyltrimethylammonium chloride, BTEAC manufactured by Lion Specialty Chemicals Co., Ltd.): 1 part by weight
- Vulcanizing agent (4,4'-dithiodimorpholine, VULNOC R manufacture by Ouchi shinko chemical industrial Co., Ltd.): 1.5 parts by weight
- Thiazole vulcanization accelerator (di-2-benzothiazolyl disulfide, NOCCELER DM-P manufactured by Ouchi shinko chemical industrial Co., Ltd.): 1.5 parts by weight
- Thiuram vulcanization accelerator (tetraethylthiuram disulfide, NOCCELER TET-G manufactured by Ouchi shinko chemical industrial Co., Ltd.): 1.8 parts by weight
- Vulcanization accelerator aid (zinc oxide, manufactured by Seido Chemical Industry Co., Ltd.): 3 parts by weight
- Stearic acid: 1 part by weight
- Heavy calcium carbonate: 40 parts by weight A SUM23L support member which has a diameter of 8 mm and is subjected to hexavalent chromate treatment after electroless nickel plating is prepared. An adhesive (epichlorohydrin-ethylene oxide-allyl glycidyl ether copolymerized rubber, HYDRINT3106 manufactured by Japan Zeon Corporation) is applied onto an outer circumferential surface of the support member so as to form an adhesive layer. The rubber composition (1) is extruded, along with the support member including the adhesive layer, from an extrusion molding machine including a cross head die (temperatures of all of a cylinder portion, a screw portion, a head portion, and a die portion are set to 80° C.). Thus, a layer of the rubber composition (1) is formed on the outer circumferential surface of the support member. Then, the layer is placed in an air heating furnace which is set to a temperature of 165° C., for 70 minutes, and the layer of the rubber composition (1) is cured, and thus an elastic roll (average diameter of 12 mm) is obtained.

Preparation of Composite Particle

A mixture having the following composition is stirred by a propeller type stirrer for 6 hours, and thus a composite particle dispersion (1) in which non-conductive porous filler particles (referred to as "composite particles" below) containing a conductive material in pores are dispersed is obtained.

Non-conductive porous filler particle: polyamide resin particle (ORGASOL2001DNat1 manufactured by Arkema Corporation, average porosity of 55% by volume, number average particle diameter of 5 μm) 10 parts by weight Conductive material: zinc oxide (PAZET AB manufactured by Hakusuitech Co., Ltd., primary particle diameter of 70 nm) 30 parts by weight Dispersing agent: polyvinyl butyral resin (S-LEC BL-1 manufactured by Sekisui Chemical Co., Ltd.) 5 parts by weight Solvent: methanol 500 parts by weight Formation of Surface Layer A mixture having the following composition is dispersed in a bead mill (zirconia beads, diameter of 1.0 mm) for 90 minutes, and thus a composition for forming a surface layer (1) is obtained.

Composite particle dispersion (1): 50 parts by weight

N-methoxymethylated nylon (F30K manufactured by Nagase ChemteX Corporation): 100 parts by weight Polyvinyl butyral resin (S-LEC BL-1 manufactured by Sekisui Chemical Co., Ltd.): 10 parts by weight Conductive material: zinc oxide (PAZET AB manufactured by Hakusuitech Co., Ltd.) 30 parts by weight Catalyst (NACURE4167 manufactured by Kusumoto Chemicals. Ltd.): 4 parts by weight Methanol: 700 parts by weight Butanol: 200 parts by weight Dip-coating with the composition for forming a surface layer (1) is performed on an outer circumferential surface of the elastic roll, and heating and drying is performed at a temperature of 160° C. for 30 minutes. Thus, a surface layer having an average layer thickness of 10 μm is formed, and a charging roll (1) is obtained.

Calculating based on a composition of materials used for forming a surface layer, the value of {the amount of the conductive material present in pores of non-conductive porous filler particle/((the amount of the conductive material present in the pores of the non-conductive porous filler particle)+(the amount of the conductive material which is dispersed and provided in the binder resin))} is 8.4% by weight.

Example 2

A charging roll (2) is obtained in the same manner as in Example 1, except that the conductive material is changed to tin oxide (S-2000 manufactured by MITSUBISHI MATERIALS CORPORATION).

Example 3

A charging roll (3) is obtained in the same manner as in Example 1, except that the conductive material is changed to carbon black (ketchen black manufactured by Lion Specialty Chemicals Co., Ltd.).

Example 4

A charging roll (4) is obtained in the same manner as in Example 1, except that the non-conductive porous filler particle is changed to a polyamide resin particle (ORGASOl2001DNat1 manufactured by Arkema Corporation, average porosity of 53% by volume, number average particle diameter of 1 μm).

Example 5

A charging roll (5) is obtained in the same manner as in Example 1, except that the non-conductive porous filler particle is changed to a polyamide resin particle (ORGASOL2001DNat1 manufactured by Arkema Corporation, average porosity of 55% by volume, number average particle diameter of 20 μm).

Example 6

A charging roll (6) is obtained in the same manner as in Example 1, except that the non-conductive porous filler particle is changed to a polyamide resin particle (ORGASOL2001DNat1 manufactured by Arkema Corporation, average porosity of 33% by volume, number average particle diameter of 5 μm).

Example 7

A charging roll (7) is obtained in the same manner as in Example 1, except that the non-conductive porous filler particle is changed to a polyamide resin particle (ORGASOL2001DNat1 manufactured by Arkema Corporation, average porosity of 68% by volume, number average particle diameter of 5 μm).

Comparative Example 1

An elastic roll (average diameter of 12 mm) is obtained in the same manner as in Example 1.

Formation of Surface Layer

A mixture having the following composition is dispersed in a bead mill (zirconia beads, diameter of 1.0 mm) for 90 minutes, and thus a composition for forming a surface layer (C1) is obtained.

N-methoxymethylated nylon (F30K manufactured by Nagase ChemteX Corporation): 100 parts by weight Polyvinyl butyral resin (S-LEC BL-1 manufactured by Sekisui Chemical Co., Ltd.): 10 parts by weight Non-conductive porous filler particle (polyamide resin particle, ORGASOL2001DNat1 manufactured by Arkema Corporation): 10 parts by weight Conductive material (zinc oxide, PAZET AB manufactured by Hakusuitech Co., Ltd.): 30 parts by weight Catalyst (NACURE4167 manufactured by Kusumoto Chemicals. Ltd.): 4 parts by weight Methanol: 700 parts by weight Butanol: 200 parts by weight Dip-coating with the composition for forming a surface layer (C1) is performed on an outer circumferential surface of the elastic roll, and heating and drying is performed at a temperature of 160° C. for 30 minutes. Thus, a surface layer having an average layer thickness of 10 m is formed, and a charging roll (C1) is obtained.

Comparative Example 2

An elastic roll (average diameter of 12 mm) is obtained in the same manner as in Example 1.

Preparation of Filler Particle Coated with Conductive Material

A filler particle having a surface coated with a conductive material is prepared by the following method.

5 parts by weight of non-conductive porous filler particles (polyamide resin particle, ORGASOL2001DNat1 manufactured by Arkema Corporation), and 5 parts by weight of carbon black particles (average particle diameter of 20 nm) are added to an edge runner in the middle of operating, and are mixed and stirred with a line load of 588 N/cm (60 kg/cm) for 60 minutes. Then, drying is performed at room temperature for 60 minutes, thereby a composite particle (C2) is obtained.

Formation of Surface Layer

A mixture having the following composition is dispersed in a bead mill (zirconia beads, diameter of 1.0 mm) for 90 minutes, and thus a composition for forming a surface layer (C2) is obtained.

Composite particle (C2): 10 parts by weight

N-methoxymethylated nylon (F30K manufactured by Nagase ChemteX Corporation): 100 parts by weight Polyvinyl butyral resin (S-LEC BL-1 manufactured by Sekisui Chemical Co., Ltd.): 10 parts by weight Conductive material: zinc oxide (PAZET AB manufactured by Hakusuitech Co., Ltd.) 30 parts by weight Catalyst (NACURE4167 manufactured by Kusumoto Chemicals. Ltd.): 4 parts by weight Methanol: 700 parts by weight Butanol: 200 parts by weight Dip-coating with the composition for forming a surface layer (C2) is performed on an outer circumferential surface of the elastic roll, and heating and drying is performed at a temperature of 160° C. for 30 minutes. Thus, a surface layer having an average layer thickness of 10 μm is formed, and a charging roll (C2) is obtained.

Comparative Example 3

An elastic roll (average diameter of 12 mm) is obtained in the same manner as in Example 1.

Formation of Surface Layer

A mixture having the following composition is dispersed in a bead mill (zirconia beads, diameter of 1.0 mm) for 90 minutes, and thus a composition for forming a surface layer (C3) is obtained.

N-methoxymethylated nylon (F30K manufactured by Nagase ChemteX Corporation): 100 parts by weight Polyvinyl butyral resin (S-LEC BL-1 manufactured by Sekisui Chemical Co., Ltd.): 10 parts by weight Conductive material (zinc oxide, PAZET AB manufactured by Hakusuitech Co., Ltd.): 30 parts by weight Catalyst (NACURE4167 manufactured by Kusumoto Chemicals. Ltd.): 4 parts by weight Methanol: 700 parts by weight Butanol: 200 parts by weight Dip-coating with the composition for forming a surface layer (C3) is performed on an outer circumferential surface of the elastic roll, and heating and drying is performed at a temperature of 160° C. for 30 minutes. Thus, a surface layer having an average layer thickness of 10 μm is formed, and a charging roll (C3) is obtained.

Observation of Surface Layer

A section sample is prepared from a surface layer of each of the charging rolls (1) to (7) and (C1) and (C2) by the above-described method, and an existence state of the conductive material is confirmed by the above-described method. It is confirmed that the conductive material is present in pores of the porous filler particle in the surface layers of the charging rolls (1) to (7). It is confirmed that the conductive material is not present in pores of the porous filler particle in the surface layer of the charging rolls (C1) and (C2). In the surface layer of the charging roll (C1), the binder resin is present in the pores of the porous filler particle. In the surface layer of the charging roll (C2), carbon black is provided on the surface of the porous filler particle in a state of forming a layer, but the conductive material is not present in the pores of the porous filler particle.

Measurement of Porosity and Particle Diameter

Regarding the charging rolls (1) to (7) and (C1) and (C2), average porosity and a number average particle diameter of porous filler particles are determined by the above-described measuring methods. The obtained values are shown in Table 1.

Image Quality Evaluation

The charging roll is mounted in a drum cartridge of DOCUCENTRE-IV C2260 (contact charging type, manufactured by Fuji Xerox Co., Ltd.) which is an electrophotographic image forming apparatus. A full halftone image having a density of 50% is printed on 10 sheets of A4 paper, and then a full halftone image having a density of 50% is printed on one sheet of paper and a full halftone image having a density of 30% is printed on one sheet of paper, under an environment of a low temperature and low humidity (a temperature of 10° C. and a relative humidity of 15%). Then, after a full halftone image having density of 50% is printed on 20,000 sheets of A4 paper, a full halftone image having a density of 50% is printed on one sheet of paper and a full halftone image having a density of 30% is printed on one sheet of paper. Two types of full halftone images are visually observed, and are classified as follows.

G1: a streaky image defect is not recognized in neither of an image having a density of 50% and an image having a density of 30%.

G2: a streaky image defect is not recognized in an image having a density of 50%, but a slight streaky image defect is recognized in an image having a density of 30%.

G3: a slight streaky image defect is recognized in both of an image having a density of 50% and an image having a density of 30%.

G4: streaky image defects are recognized to be scattered on the entire surface in both of an image having a density of 50% and an image having a density of 30%.

TABLE 1

| | | Filler particle | | | | | | Image quality evaluation | |
|---|---|---|---|---|---|---|---|---|---|
| | Charging roll | Type | Shape | Average porosity | Number average particle diamerter | Composite of filler particle and conductive material | Type of conductive material for composite | Initial time | After printing on 20,000 sheets |
| Example 1 | (1) | polyamide resin particle | porous medium | 55% by volume | 5 μm | insertion into pores | zinc oxide | G1 | G1 |
| Example 2 | (2) | polyamide resin particle | porous medium | 55% by volume | 5 μm | insertion into pores | tin oxide | G1 | G1 |
| Example 3 | (3) | polyamide resin particle | porous medium | 55% by volume | 5 μm | insertion into pores | carbon black | G1 | G2 |
| Example 4 | (4) | polyamide resin particle | porous medium | 53% by volume | 1 μm | insertion into pores | zinc oxide | G1 | G2 |

TABLE 1-continued

| | | Filler particle | | | | | | Image quality evaluation | |
|---|---|---|---|---|---|---|---|---|---|
| | Charging roll | Type | Shape | Average porosity | Number average particle diamerter | Composite of filler particle and conductive material | Type of conductive material for composite | Initial time | After printing on 20,000 sheets |
| Example 5 | (5) | polyamide resin particle | porous medium | 55% by volume | 20 μm | insertion into pores | zinc oxide | G1 | G2 |
| Example 6 | (6) | polyamide resin particle | porous medium | 33% by volume | 5 μm | insertion into pores | zinc oxide | G1 | G2 |
| Example 7 | (7) | polyamide resin particle | porous medium | 68% by volume | 5 μm | insertion into pores | zinc oxide | G1 | G2 |
| Comparative Example 1 | (C1) | polyamide resin particle | porous medium | 55% by volume | 5 μm | none | — | G1 | G4 |
| Comparative Example 2 | (C2) | polyamide resin particle | porous medium | 55% by volume | 6 μm | coating | carbon black | G1 | G3 |
| Comparative Example 3 | (C3) | | | | | | | G4 | G4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a support member; and a surface layer which is provided on the support member and contains a non-conductive porous filler particle and a conductive material present in pores of the non-conductive porous filler particle.

2. The charging member according to claim 1, wherein the conductive material is a metal oxide particle.

3. The charging member according to claim 1, wherein the metal oxide particle is at least one selected from zinc oxide, tin oxide, and titanium oxide.

4. The charging member according to claim 1, wherein a primary particle diameter of the metal oxide particle is from 5 nm to 100 nm.

5. The charging member according to claim 1, wherein an average porosity of the non-conductive porous filler particles is from 30% by volume to 70% by volume.

6. The charging member according to claim 1, wherein an average porosity of the non-conductive porous filler particles is from 50% by volume to 60% by volume.

7. The charging member according to claim 1, wherein a particle diameter of the non-conductive porous filler particle is from 1 μm to 20 μm.

8. The charging member according to claim 1, wherein a particle diameter of the non-conductive porous filler particle is from 2 μm to 10 μm.

9. The charging member according to claim 1, wherein a particle diameter of the non-conductive porous filler particle is from 3 μm to 8 μm.

10. The charging member according to claim 1, wherein a content of the non-conductive porous filler particle in the surface layer is from 3% by volume to 20% by volume.

11. A process cartridge that is detachable from an image forming apparatus, comprising:

an electrophotographic photoreceptor; and a charging device that charges a surface of the electrophotographic photoreceptor and includes the charging member according to claim 1, which is provided to contact the surface of the electrophotographic photoreceptor.

12. An image forming apparatus comprising:

an electrophotographic photoreceptor;

a charging device that charges a surface of the electrophotographic photoreceptor and includes the charging member according to claim 1, which is provided to contact the surface of the electrophotographic photoreceptor;

a latent image forming device that forms a latent image on a charged surface of the electrophotographic photoreceptor;

a developing device that develops the latent image formed on the surface of the electrophotographic photoreceptor by a developer containing a toner, so as to form a toner image; and a transferring device that transfers the toner image formed on the surface of the electrophotographic photoreceptor to a recording medium.

* * * * *